US010604855B2

(12) United States Patent
Proshkin et al.

(10) Patent No.: US 10,604,855 B2
(45) Date of Patent: Mar. 31, 2020

(54) LINING OF A CATHODE ASSEMBLY OF A REDUCTION CELL FOR PRODUCTION OF ALUMINUM, METHOD FOR INSTALLATION THEREOF AND REDUCTION CELL HAVING SUCH LINING

(71) Applicant: United Company RUSAL Engineering and Technology Centre LLC, g. Krasnoyarsk (RU)

(72) Inventors: Aleksandr Vladimirovich Proshkin, g. Krasnoyarsk (RU); Gennadij Efimovich Nagibin, g. Krasnoyarsk (RU); Vitalij Valer'evich Pingin, g. Krasnoyarsk (RU); Andrej Gennad'evich Sbitnev, g. Krasnoyarsk (RU); Aleksej Sergeevich Zherdev, g. Krasnoyarsk (RU); Viktor Khrist'yanovich Mann, g. Krasnoyarsk (RU); Yuriy Mikhailovich Shtefanyuk, g. Krasnoyarsk (RU)

(73) Assignee: UNITED COMPANY RUSAL ENGINEERING AND TECHNOLOGY CENTRE LLC, Krasnoyarsk (RU)

( * ) Notice: Subject to any disclaimer, the term of this patent is extended or adjusted under 35 U.S.C. 154(b) by 171 days.

(21) Appl. No.: 15/753,142

(22) PCT Filed: Sep. 9, 2016

(86) PCT No.: PCT/RU2016/000619
§ 371 (c)(1),
(2) Date: Feb. 15, 2018

(87) PCT Pub. No.: WO2017/044010
PCT Pub. Date: Mar. 16, 2017

(65) Prior Publication Data

US 2018/0237926 A1 Aug. 23, 2018

(30) Foreign Application Priority Data

Sep. 10, 2015 (RU) ..... 2015138693

(51) Int. Cl.
*C25C 7/06* (2006.01)
*C25C 3/16* (2006.01)
(Continued)

(52) U.S. Cl.
CPC ..... *C25C 3/085* (2013.01); *C25C 3/06* (2013.01); *C25C 3/08* (2013.01)

(58) Field of Classification Search
CPC .. C25C 3/08; C25C 3/06; C25C 3/085; C25C 7/005; C25C 3/16; C25C 7/025; C25C 7/06; C25C 3/10
See application file for complete search history.

(56) References Cited

FOREIGN PATENT DOCUMENTS

RU 2385972 * 4/2010 ..... C25C 3/08

* cited by examiner

*Primary Examiner* — Zulmariam Mendez
(74) *Attorney, Agent, or Firm* — Hogan Lovells US LLP

(57) ABSTRACT

The present invention relates to nonferrous metallurgy, in particular to the electrolytic production of aluminum, more particularly to a structure of a cathode assembly of a reduction cell for production of aluminum. A lining of a cathode assembly of an aluminum reduction cell is provided which comprises a thermal insulation layer and a fire-resistant layer consisting of no less than two sub-layers, wherein the porosity of the thermal insulation layer and the fire-resistant layer increases from an upper sub-layer to a bottom sub-layer and the thickness ratio of the fire-resistant layer and the thermal insulation layer is no less than ⅓. Also, the present invention provides a method for lining a cathode assembly of a reduction cell and a reduction cell having the claimed cathode assembly lining. The invention is aimed at the reduction of the cyanide content in upper thermal
(Continued)

insulation layers and to provision of conditions for material reuse in the thermal insulation layer, waste reduction and improvement of the environmental situation on aluminum production facilities.

12 Claims, 5 Drawing Sheets

(51) Int. Cl.

| | |
|---|---|
| ***C25C 3/10*** | (2006.01) |
| ***C25C 3/08*** | (2006.01) |
| ***C25C 3/06*** | (2006.01) |

LINING OF A CATHODE ASSEMBLY OF A REDUCTION CELL FOR PRODUCTION OF ALUMINUM, METHOD FOR INSTALLATION THEREOF AND REDUCTION CELL HAVING SUCH LINING

This application is a U.S. National Phase under 35 U.S.C. § 371 of International Application PCT/RU2016/000619, filed on Sep. 9, 2016, which claims priority to Russian application 2015138693, filed on Sep. 10, 2015. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF THE INVENTION

The present invention relates to nonferrous metallurgy, in particular to the electrolytic production of aluminum, more particularly to a structure of a cathode assembly of a reduction cell for production of aluminum.

PRIOR ART

It is known a cathode assembly of a reduction cell for production of aluminum which comprises a metal shell lined with side blocks of carbon-graphite blocks; a base comprised of a loose material made from screenings of quartzite having a fraction of 2-20 mm which is a waste from production of crystal silicon; bottom carbon-graphite blocks having current-carrying rods and interblock joints (RU 2061796, IPC C25C3/08, published on 10 Jun. 1996).

Drawbacks of such reduction cell cathode assembly include increased energy consumption for reduction cell operation caused by high thermal conductivity coefficients of layers of screenings of quartzite having a fraction of 2-20 mm, the instability of temperature fields in the cathode assembly caused by the interaction between quartzite layers and sodium vapors and generation of high-conductivity glass—sodium bisilicate. Moreover, at the end of its service life, the worked-out lining soaked with fluoride salts shall be safely landfilled or effectively disposed of which requires additional expenditures.

The closest to the claimed cathode lining in terms of its technical effect is a lining of a cathode assembly of an aluminum reduction cell having a cathode shell and angular bottom blocks which includes a fire-resistant layer and a thermal insulation layer comprised of two layers of calcined alumina of different density: an upper layer density is 1.2-1.8 tonnes/$m^3$, a lower layer density is 1 tonne/$m^3$, wherein the total height of the thermal insulation layer is 0.5-1.0 of the height of a bottom unit, and the ratio of the upper layer height to the of lower layer height is from 1:1 to 1:2 (SU No. 1183564, IPC C25C 3/08, published on 7 Oct. 1985).

The drawbacks of the prototype include high costs of a deep-calcined (at the temperature no more than 1200° C.) alumina, high energy consumption due to the high thermal conductivity coefficient of the insulation layer made of $\alpha$-$Al_2O_3$ and incapability of material recycling for the intended purpose as a lining material.

It is known a method for installing a bottom of aluminum reduction cells which comprises installing bottom carbon-graphite blocks with current-carrying rods—cathode sections—onto an unhardened layer of a heat- and chemically-resistant concrete, previously poured onto a bearing floor of the reduction cell, followed by filling interblock and peripheral joints with a ramming paste (SU No. 1261973, IPC C25C3/06, published on 7 Oct. 1986).

The drawbacks of such method for installing the bottom of the cathode assembly of the reduction cell include intensive energy consumption for reduction cell operation due to high thermal conductivity coefficients of a heat- and chemically-resistant concrete, as well as incapability to recycle such non-shaped material.

The closest to the claimed method in terms of its technical features is a method for lining a cathode assembly of a reduction cell for production of aluminum which comprises filling a cathode assembly shell with a thermal insulation layer of non-graphitic carbon; forming a fire-resistant layer by vibro-compaction of an alumino-silicate powder; installing bottom and side blocks followed by sealing joints therebetween with a cold ramming paste (RU 2385972, IPC C25C3/08, published on 10 Apr. 2010).

The drawback of the prototype includes the formation of sodium cyanide in upper layers of a thermal insulation and the formation of monolithic pieces of sodium carbonate which does not allow their re-use.

DISCLOSURE OF THE INVENTION

The object of the aforementioned solutions is to provide conditions for re-use of a used lining material by shortening the content of sodium cyanides in upper thermal insulation layers.

The above mentioned object is achieved by that a cathode assembly lining of an aluminum reduction cell which comprises bottom and side blocks interconnected with a cold ramming paste, a fire-resistant layer and a thermal insulation layer are made of non-shaped materials, wherein the fire-resistant layer consists of an alumino-silicate material and the thermal insulation layer consists of non-graphitic carbon or a mixture thereof with an alumino-silicate or alumina powder; in accordance with the inventive solution, the thermal insulation layer and the fire-resistant layer consist of at least two sub-layers, wherein the porosity of the thermal insulation and fire-resistant layers increases from an upper sub-layer to a bottom sub-layer and the thickness ratio of the fire-resistant layer and the thermal insulation layer is no less than ⅓, preferably 1:(1-3).

The inventive device is completed with specific features.

It is preferred that the growth rate of the fire-resistant layer porosity from the upper sub-layer to the bottom sub-layer is between 17 and 40% and the porosity growth rate of the thermal insulation layer from the upper sub-layer to the bottom sub-layer is between 60 to 90%. In this way, non-shaped materials can be used without being further sintered to keep fire-resistance characteristics unchanged.

As one of the sub-layers of the fire-resistant layer, it is required to use a natural material, such as porcellanite which is the most widely available material from the existent natural materials. Also, as a waste material, a grog powder or a fly ash can be used but these materials have lower quality. A graphite foil is placed between the sub-layers of the fire-resistant layer.

Upper sub-layers of the fire-resistant layer restrict permeation of molten fluoride salts into a lower part of a base. The denser sub-layers are, the smaller pores are, the higher resistance to penetration of molten fluoride salts of the cathode assembly is (FIG. 4). Particularly good results demonstrate a graphite foil with very small pores which substantially stops the liquid phase of fluoride salts. However, sodium partially penetrates into the non-graphitic carbon or a mixture thereof with an alumino-silicate or alumina powder. Since a non-graphitic carbon is suggested as a thermal insulation layer, nitrogen which is comprised in the pores of this carbon can interact with sodium and create sodium cyanides. The higher the temperature, the more concentrated cyanides are (FIG. 5). That is why the fire-resistant layer thickening reduces the temperature and slows down the creation of sodium cyanides. In addition, the mixture of non-graphitic carbon with the alumino-silicate or alumina powder inhibits the creation of cyanides within the non-graphitic carbon pores. The thinning of the fire-resistant layer lower than the claimed limit will help in the formation of cyanides but at the same time in the increase of the heat-resistance of the base, and the thickening of the fire-resistant layer above the claimed limit will result in lower content of cyanides in the thermal insulation layer but at the same time in lower heat-resistance and higher heat losses.

From the other hand, it is required to have the highest as possible heat-resistance of the base; this can be achieved by a very porous structure of the thermal insulation layer and the fire-resistant layer since gases inside the pores of these layers have the lowest thermal conductivity coefficient.

The optimal ratio between the thermal insulation layer and the fire-resistant layer can be found based on the minimal cyanide formation condition and the maximal heat-resistance condition.

Besides, the object of the invention can be achieved by that a method for lining a cathode assembly of a reduction cell for production of aluminum, which comprises filling a cathode assembly shell with a thermal insulation layer consisting of non-graphitic carbon; forming a fire-resistant layer; installing bottom and side blocks followed by sealing joints therebetween with a cold ramming paste, an upper sub-layer of the thermal insulation layer is advantageously filled with non-graphitic carbon previously removed from a lower sub-layer of a thermal insulation layer of an earlier used cathode assembly of the reduction cell or a mixture thereof with porcellanite. For this, the thermal insulation layer and the fire-resistant layer are required to consist of at least two sub-layers, where the porosity of the thermal insulation layer and the fire-resistant layer increases from an upper sub-layer to a bottom sub-layer and the thickness ratio of the fire-resistant layer and the thermal insulation layer is no less than ⅓, preferably 1:(1-3).

Also, it is provided a reduction cell for production of aluminum which comprises a cathode assembly comprising a bath with a carbon bottom made of angular blocks having cathode conductors embedded therein and enclosed inside a metal shell, wherein fire-resistant and thermal insulation materials are placed between the metal shell and angular blocks; an anode device comprising one or more angular anodes connected to an anode bus and arranged at the top of the bath and immersed in a molten electrolyte. In addition, the cathode assembly lining is made as mentioned above.

If compared with known technical solutions, the inventive cathode assembly, the method for lining and the reduction cell with said lining make it possible to lower the cyanide content in upper thermal insulation layers, to allow the reuse of the thermal insulation layer, as well as to reduce wastes and improve the environmental situation in places of aluminum production facilities.

Suggested parameters are optimal. If the thickness of the fire-resistant layer is less than ⅓, the number of cyanides in the carbon material of the thermal insulation layer which are formed from the reaction (1):

$$2Na_{vap}+N_2+C=2NaCN, \quad (1)$$

$$\Delta G^\circ_{973\ K}=-151980\ J$$

will be high enough posing environmental threats upon the cathode assembly disassembling and the material re-usage in the thermal insulation layer.

Having the increased thickness of the fire-resistant alumino-silicate layer ensures bonding of the penetrating sodium to obtain stable compounds:

$$4Navap+2Al_2O_3+13SiO_2=4(NaAlSi_3O_8)+Si, \quad (2)$$

$$\Delta G^\circ_{1123\ K}=-587460\ J$$

$$4Navap+2Al_2O_3+5SiO_2=4(NaAlSiO_4)+Si, \quad (3)$$

$$\Delta G^\circ 1123\ K=-464210\ J$$

However, if the thickness of the fire-resistant layer is higher than the thickness of the thermal insulation layer, the thermal efficiency of the cathode assembly will be lower, since the heat-resistance of alumino-silicate brick layers is lower than that of non-graphitic carbon layers. Consequently, non-conductive deposits are formed on a working surface of bottom blocks making the temperature in the bottom blocks more uneven and resulting in the premature failure.

The fire-resistant layer made of alumino-silicate materials must be separated into two and more layers having height-wise varying porosity for the following reasons.

The primary function of upper layers is to stop components of electrolytic liquid phase from permeating the below underlying layers. The problem with the use of non-shaped materials for barrier layers is in that these materials are heterogeneous substances having a solid ingredient which is well wettable with fluoride salts permeating through open pores. A number of fluoride salts permeating through the barrier depends on the size distribution of a raw powder for the mixture, a compaction process and further heat-and-chemical processing conditions.

In accordance with Darcy's law, the driving force for the permeation of molten fluoride salts is the pressure gradient over the barrier material height.

$$q=-\frac{k}{\mu}\frac{dP}{dx} \quad (4)$$

where:

q is the volume flow rate of molten fluoride salts through the cross-sectional area S, m3/(m2s);

k is the permeability, m2;

dP/dx is the pressure gradient over the barrier material height, Pa;

μ is the dynamic viscosity, Pa·s.

For large pores (more than 100 μm), the pressure gradient depends advantageously on hydrostatic and gravitational forces. For medium channel pores (from 5 to 25 μm) the potential energy of the field of capillary forces determines much higher pressure gradient than for the large pores, and such capillaries can actively absorb molten fluoride salts. For the smallest pores, hydraulic resistance to molten fluoride salt motion is very high, they are filled very slowly and the amount of permeating fluoride salts is minimal. If the size distribution is correct and compaction is made properly it is possible to obtain fire-resistant layers with the low porosity and very small pores.

The permeability from the equation (1) is the function of sizes and number of pores and can be assessed based on its structural parameters, such as open porosity, pore size and tortuosity coefficient distribution. For porous materials with evenly distributed and mutually disjoint pores in the form of small-section cylindrical channels, the permeability can be determined based on the following equation:

$$k = \Pi\frac{d^2}{32} \tag{5}$$

where: Π is the porosity; d is the pore size, m; k is the permeability.

As can be seen from the above relationships, with the increase in the porosity and pore sizes the amount of permeating electrolytic components is increased, and vice versa, with decrease in the porosity (and accordingly, in pore sizes) fluoride salts permeate the barrier material slowly and the reaction of interaction takes place in its surface layers (FIG. 4).

When non-shaped alumina-silicate barrier materials comprise complex silica ions that make an embedding melt more viscous and, accordingly, slow down its permeation rate, the chemical interaction between components of fluoride salts and the barrier material and the dissolution of the material retard the effect of electrolytic components permeation. That is why it is important for the upper sub-layer of the fire-resistant layer to be as compact as possible and to have thoroughly selected size distribution. Typically, the maximum compaction capacity and the minimum possible open porosity of such fill layers is approx. 15%. However, the more compacted the barrier material, the more of it is needed, and the higher thermal conductivity coefficient results in the lower heat-resistance of the cathode assembly and increased heat losses, thus, reducing the cost-effectiveness of the cathode lining.

Barrier materials are impregnated with electrolytic components to increase the thermal conductivity coefficient thereof and to obtain temperature field reconstruction which results in that liquidus isotherm of fluoride salts moves downwards.

The less barrier material layer compacted, the further isotherm is moved down and the more of the barrier material is in the high-temperature area and subjected to the chemical effect across the entire volume; this leads to changes in the volume which vertically impact the bottom blocks. The latter reduces the service life of cathode assemblies of reduction cells.

An additional chance to slow down the permeation of the liquid phase is to install a graphite foil under the upper sub-layer of an alumino-silicate fire-resistant material.

Under the foil, there is a fire-resistant layer with the porosity which is higher than that of the upper layer and with the higher silica content. On the one hand, this is due to the need to absorb sodium, and on the other hand due to the need to form a porous sublayer of the fire-resistant layer with the higher temperature gradient over its height and temperature reduction within the underlying layer of thermal insulation materials comprised of non-graphitic carbon materials (partially carbonized lignite). This can lead to cyanide content reduction. However, the porosity more than 40% is undesirable because in this case, the lower sub-layer of the fire-resistant layer can shrink.

For the sub-layer of the fire-resistant layer, it is suggested to use a natural material, such as porcellanite (naturally burnt clays) comprising silica (~65%) and aluminum oxide (~20%) which react with gaseous sodium to form albite and nepheline. Chemical compositions of burnt clays differ from that of grog and have more fluxes (Na2O, K2O, $Fe_nO_m$) and less aluminum oxide. Silica concentrations in grog and in porcellanite are substantially equal. That is why the described materials can both bound sodium in such way to obtain a stable chemical compound—albite.

The lower aluminum oxide concentration will only reduce the amount of the resulted nepheline. High levels of ferrous oxides with silica being present in the system will facilitate sodium bounding to form sodium silicate:

$$2Na+FeO+SiO_2=Fe+Na_2SiO_3, \Delta G^\circ_{973\ K}=-345580\ J. \tag{6}$$

Porcellanite acting as a barrier material must be arranged in the temperature zone below 718° C. since at higher temperatures the gaseous phase (CO—$CO_2$) can reduce ferrous oxides:

$$FeO+C=Fe+CO, \Delta G^\circ_{991\ K}=0. \tag{7}$$

The increased iron content in burnt clays can be considered as a positive factor since by adding such clays into partially carbonized lignites can prevent the formation of sodium cyanide which, during iron reduction, is less likely to be formed than sodium silicates:

$$2Na_{vap}+N2+C=2NaCN, \Delta G^\circ_{973\ K}=-151980\ J. \tag{8}$$

Porcellanite is a material that has already undergone the sintering stage and is desired as a fire-resistant non-shaped material for lining aluminum reduction cells of various designs. With regard to the fire-resistance, burnt clays are between chamotte (~1550° C.) and diatomite (~1000° C.) bricks. That is why non-shaped barrier materials based on burnt clays can be used as an intermediate fire-resistant material to be arranged in a cathode assembly of a reduction cell between a dry barrier mix (DBM) based on grog and thermal insulation materials, such as diatomite bricks, vermiculite plates or partially carbonized lignites.

Thanks to its characteristics and low price, this material can be well competitive in the current electrolytic production of aluminum.

The effect of sodium on porcellanite is different from that in chamotte. Iron is first to be reduced until a free state is achieved and only after that the silicon reduction begins to obtain albite, nepheline, sodium silicate and iron silicide. At the end of interaction between sodium and burnt clays, as well as at the end of interaction between sodium and chamotte, sodium aluminate and sodium silicate will be obtained. The only difference is the great amount of the metal phase.

The upper sub-layer of the thermal insulation material is made of non-graphitic carbon (partially carbonized lignite). It has a low density and thermal conductivity coefficient which is due to the closed porosity. To maintain thermal insulation properties the total porosity of the upper layer of the thermal insulation must be no less than 60%, and to prevent overshrinking the total porosity of the lower layer no more than 90%.

In use, depending on the thickness, heat-resistance, and sodium absorption ability of the above fire-resistant layers, a certain amount of sodium cyanides can be created in upper sub-layers of thermal insulation layers. However, a mixture of non-graphitic carbon and alumino-silicate materials (e.g., porcellanite) will always result in reduced cyanide content in upper thermal insulation layers.

Such technical effect can be achieved only with the claimed parameter ratios of structural elements of the device and the lining method.

BRIEF DESCRIPTION OF DRAWINGS

The essence of the invention will be better understood upon studying following drawings.

EMBODIMENTS OF THE INVENTION

Figure 1:
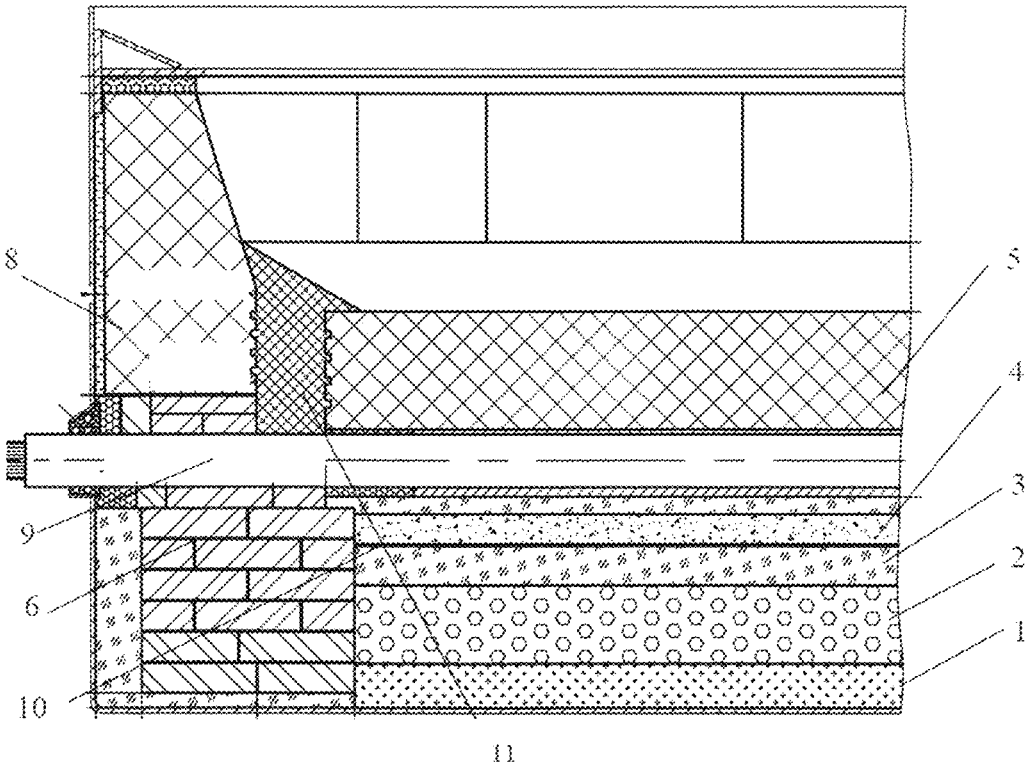
FIG. 1 is a representation of a cathode lining of a reduction cell.

In FIG. 1 a lining consists from a lower sub-layer of a thermal insulation layer comprised of non-graphitic carbon material 1 with the porosity to 90%, an overlying upper sub-layer of a thermal insulation layer 2 with the porosity to 60% over which is arranged a lower sublayer 3 of an alumino-silicate fire-resistant layer (porcellanite) with the porosity up to 40% covered with an upper sub-layer of a fire-resistant layer 4 with the porosity up to 17% and highly resistant to permeation of electrolytic components through a bottom consisted of carbon blocks 5. The periphery of an inner side of a metal shell is laid with brick lip 6. A bottom mass 7 fills the space between carbon blocks 5 and a side block 8. A collector bar 9 is connected to the carbon block 5. A graphite foil 10 is placed under the upper sub-layer of the fire-resistant layer. A peripheral joint 11 passes between the carbon blocks 5 and the brick lip 6.

Figure 2:
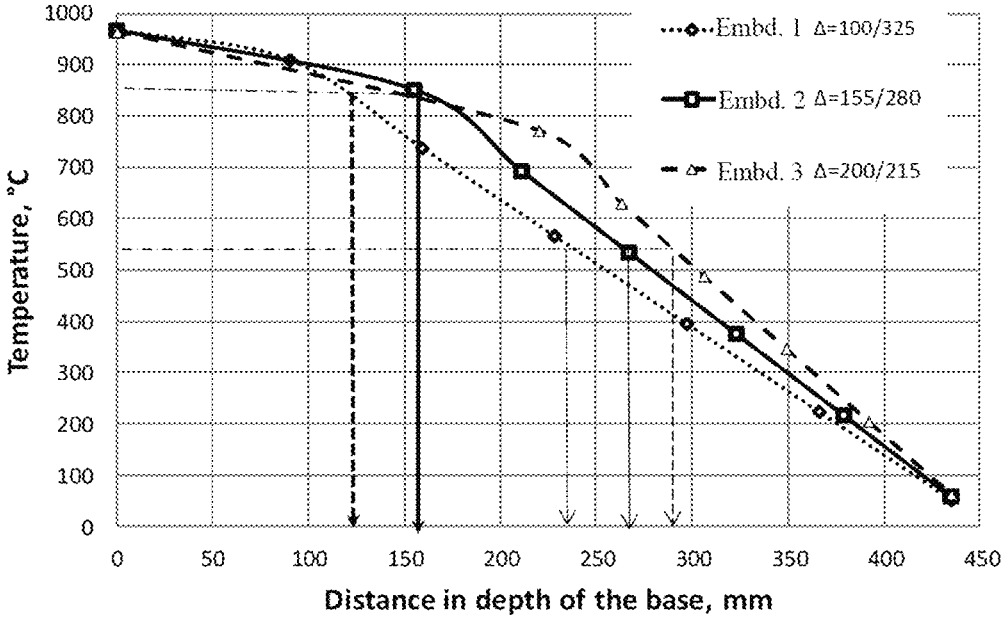
FIG. 2 is a graph of the computed distribution of temperatures over the height of the lining base, where the X-axis represents a distance in depth of the base passing vertically from a floor of a bottom unit, and the Y-axis represents temperature estimated values.

The calculation results for three embodiments of cathode lining of the reduction cell for production of primary aluminum are shown in FIG. 2.

In accordance with the first embodiment, for the total height of the space under a cathode of 425 mm, the thickness of the fire-resistant layer was 100 mm and the thickness of the thermal insulation layer was 325 mm. Thickness ratio of the fire-resistant layer and the thermal insulation layer was ~(1:3.25).

In accordance with the second embodiment, the thickness of the fire-resistant layer was 155 mm and the thickness of the thermal insulation layer was 280 mm. Thickness ratio of the fire-resistant layer and the thermal insulation layer was ~(1:1.8).

In accordance with the third embodiment, the thickness of the fire-resistant layer was 200 mm and the thickness of the thermal insulation layer was 215 mm. Thickness ratio of the fire-resistant layer and the thermal insulation layer was ~(1:1.1).

The Y-axis represents two temperature values. The first value 852° C. is the melt temperature of sodium carbonate, the second value 542° C. is the sodium crystallization temperature under the cathode.

As can be seen from the data for the first embodiment, sodium carbonate is formed at the depth of 120-125 mm. The thickness of the alumino-silicate fire-resistant layer (the barrier mix) for the given mixture was 100 mm. That is why at the depth of 20-25 mm inside the thermal insulation layer a rich in cyanide powder material is formed. In the lower layer, cyanides are located in monolithic sodium carbonate and the ecological threat is minimal since bottom blocks are a typical place for sodium cyanides to form.

In accordance with the third embodiment where the maximum thickness of the fire-resistant layer is 200 mm, sodium carbonate in the thermal insulation is formed below the layer and there is no risk of cyanide dispersion in the form of dust. However, at the same time thermal- and cost-effectiveness of the cathode assembly is at the lowest because of the high thermal conductivity coefficient and the high price of the fire-resistant layer comparing to the carbon material.

That is why the embodiment 2 where the thickness of the dry barrier mix is 155 mm is preferable compared to the embodiments 1 and 3, since in the first embodiment, in the upper sub-layers of the thermal insulation layer unacceptably high amount of sodium cyanides is formed which is confirmed by results of the autopsy of a test reduction cell. The third embodiment is not optimal because of the heat loss through the shell bottom, and some sub-layers of the thermal insulation layer are replaced by sub-layers of the fire-resistant layer which have the higher thermal conductivity coefficient. Besides, since the fire-resistant material is more expensive, the lining cost is also increased.

The cathode lining of the reduction cell for production of primary aluminum is implemented using the same method as follows.

A used cathode assembly having non-shaped materials is pre-disassembled. In use, non-graphitic carbon from a thermal insulation layer is transformed into a two-layer material. From below it preserves its powder state and from above it has a bound monolithic structure with a dark-greasy shade. The material is arranged in the space between isotherm 850° C. that corresponds to the liquidus temperature of sodium carbonate and the condensation temperature 540° C. of sodium under a condition of operation of materials under the cathode.

The material from the lower sub-layer of the thermal insulation layer placed below isotherm 540° C. preserves its initial characteristics and advantageously consists of carbon ~95% (Table 1).

TABLE 1

Results of X-ray phase analysis of the material composition of the lower sub-layer of the thermal insulation layer of the lining

| Substance | Material | Center | Periphery |
|---|---|---|---|
| C | Carbon | 88.7 | 76.6 |
| C | Graphite | 6.25 | 5.13 |
| CaO | Lime | 1.13 | 3.04 |
| $Na_2CO_3$ | Gregoryite, syn | 0 | 1.15 |
| $Na_2CO_3$ | | 0 | 10.3 |
| $CaCO_3$ | Calcite | 2.06 | 2.57 |
| $CaMg_{0.7}Fe_{0.3}(CO_3)_2$ | Dolomite | 0 | 0.28 |
| NaCN | | 0 | 0.76 |
| $SiO_2$ | Quartz | 1.75 | 0 |

Cyanide concentration in this area found by the photometric technique was 0.12 and 0.43%, respectively.

The monolithic area arranged above advantageously consists of sodium carbonate and carbon (Table 2). Cyanide concentration in this area found by the photometric technique was 4.3%. The thermal conductivity coefficient of lower layers of lining materials doesn't change its initial value: ~0.09 W/(μK). That is why non-graphitic carbon or a mixture thereof with an alumina-silicate or alumina powder can be re-used to shape the upper sublayer of the thermal insulation layer without additional treatment.

TABLE 2

Results of X-ray phase analysis of the material composition of the upper sub-layer of the thermal insulation layer of the lining

| Substance | Material | Center | Periphery |
|---|---|---|---|
| C | Carbon | 33.1 | 31.5 |
| C | Graphite | 0.96 | 1.96 |
| CaO | Lime | 4.41 | 6.32 |
| Na2CO3 | Gregoryite, syn | 3.48 | 5.4 |
| $Na_2CO_3$ | | 25.9 | 0 |
| $Na_2CO_3$ | Natrite | 30.1 | 54 |
| $CaMg_{0.7}Fe_{0.3}(CO_3)_2$ | Dolomite | 1.85 | 0.67 |

At the same time, non-graphitic carbon mixed with an alumino-silicate material (porcellanite$o_M$) can be used. The lower thermal conductivity coefficient of this mixture is lower than for the single porcellanite and the cyanide content therein is lower than in the non-graphitic carbon. It is confirmed by the results obtained based on the operation of a test reduction cell where a mixture of non-graphitic carbon and an alumino-silicate powder was arranged directly beneath bottom blocks. The content of sodium cyanides in the mixed material removed from the reduction cell after more than 2300 days of operation was 0.4%.

Figure 3:
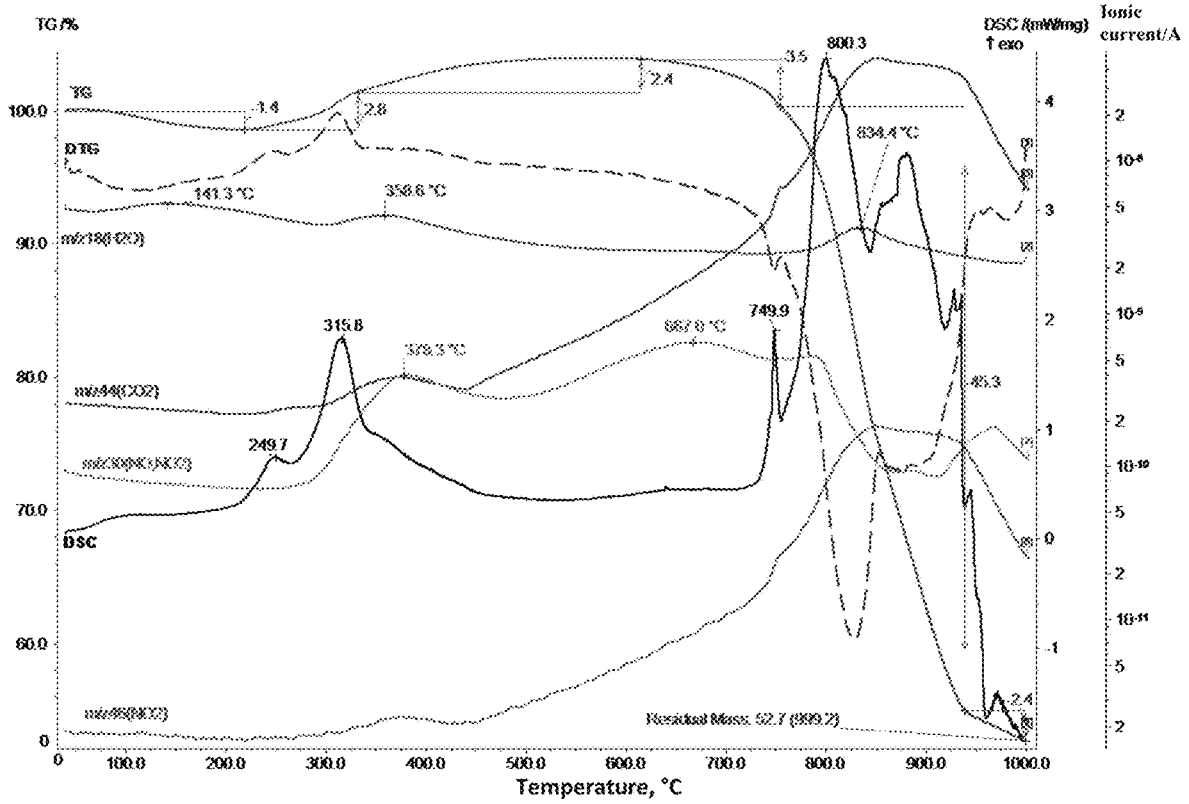
FIG. 3 is a representation of the permeability vs pore sizes.
Figure 4:
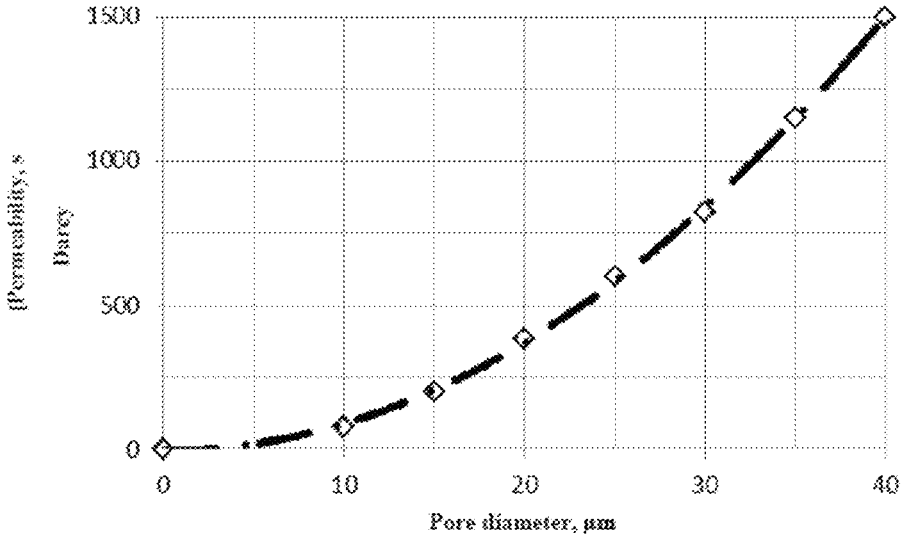
FIG. 4 is a representation of sodium cyanide content in different materials vs temperature.
Figure 5:
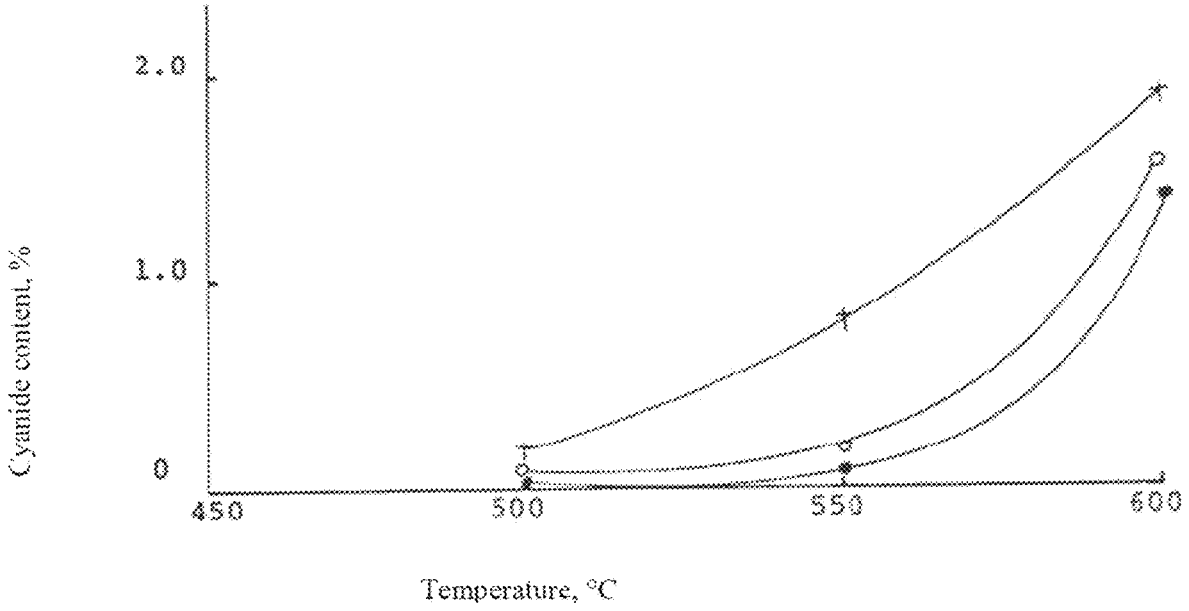
FIG. 5 is a representation of sodium cyanide content in different materials vs temperature.

For the upper sublayer of the thermal insulation layer, a thermal conductivity coefficient is much higher –0.5 W/(μK). Taking into account the higher content of cyanides and the presence of lumps, it is impossible to reuse the material from the upper sub-layer of the thermal insulation layer for a direct purpose. The most efficient way to dispose of the material of the upper sub-layer of the thermal insulation layer is the direct incineration accompanying with heat energy generation. According to the results of the derivatographic analysis (FIG. 3), this needs sufficient temperatures above 600° C.

As a non-graphitic carbon, it is desired to use products of lignite pyrolysis produced at 600-800° C. At lower temperatures, there is no explosion security because the content of volatile substances is high, and at a higher temperature the carbon residue is reduced as well as the process performance.

The use of abovementioned cathode lining and the method for lining allows to reduce the cyanide content in the upper thermal insulation layers and to provide conditions for reuse of the material for the thermal insulation layer and to reduce wastes and improve the environmental situation in places of aluminum production facilities.

The invention claimed is:

1. A lining of a cathode assembly of a reduction cell for production of aluminum which comprises bottom and side blocks interconnected with a cold ramming paste, a fire-resistant layer and a thermal insulation layer made of non-shaped materials, wherein the fire-resistant layer consists of an alumino-silicate material and the thermal insulation layer consists of non-graphitic carbon or a mixture thereof with an alumino-silicate or alumina powder, characterized in that the thermal insulation layer and the fire-resistant layer consist of no less than two sub-layers, wherein the porosity of the thermal insulation and fire-resistant layers increases from an upper sub-layer to a bottom sub-layer and the thickness ratio of the fire-resistant layer and the thermal insulation layer is no less than ⅓.

2. The lining of claim 1, characterized in that the thickness ratio of the fire-resistant layer and the thermal insulation layer is 1: (1-3).

3. The lining of claim 1, characterized in that the growth rate of the fire-resistant layer porosity from the upper sub-layer to the bottom sub-layer is between 17 and 40% and the porosity growth rate of the thermal insulation layer from the upper sub-layer to the bottom sub-layer is between 60 to 90%.

4. The lining of claim 1, characterized in that as one of the sub-layers of the fire-resistant layer a natural material is used, in particular, porcellanite.

5. The lining of claim 1, characterized in that a graphite foil is placed between sub-layers of the fire-resistant layer.

6. The lining of claim 1, characterized in that products of lignite pyrolysis produced at 600-800° C. are used as non-graphitic carbon.

7. A method for lining a cathode assembly of a reduction cell for production of aluminum which comprises filling a cathode assembly shell with a thermal insulation layer consisting of non-graphitic carbon, forming a fire-resistant layer, installing bottom and side blocks followed by sealing joints therebetween with a cold ramming paste, characterized in that an upper sub-layer of a thermal insulation layer is advantageously filled with non-graphitic carbon previously removed from a lower sub-layer of a thermal insulation layer of an earlier used cathode assembly of the reduction cell or a mixture thereof with porcellanite and having a thermal conductivity coefficient and packed density not exceeding the initial ones, wherein the thermal insulation layer and the fire-resistant layer consist of no less than two sub-layers, wherein the porosity of the thermal insulation and fire-resistant layers increases from the upper sub-layer to the bottom sub-layer and the thickness ratio of the fire-resistant layer and the thermal insulation layer is no less than ⅓.

8. The method of claim 7, characterized in that the thickness ratio of the fire-resistant layer and the thermal insulation layer is advantageously 1: (1-3).

9. The method of claim 7, characterized in that the growth rate of the fire-resistant layer porosity from the upper sub-layer to the bottom sub-layer is between 17 and 40% and the porosity growth rate of the thermal insulation layer from the upper sub-layer to the bottom sub-layer is between 60 to 90%.

10. The method of claim 7, characterized in that as one of the sub-layers of the fire-resistant layer a natural material is used, in particular, porcellanite.

11. The method of claim 7, characterized in that a graphite foil is placed between the sub-layers of the fire-resistant layer.

12. A reduction cell for production of aluminum which comprises a cathode assembly comprising a bath with a carbon bottom made of angular blocks having cathode conductors embedded therein and enclosed inside a metal shell, wherein fire-resistant and thermal insulation materials are placed between the metal shell and the angular blocks; an anode device comprising one or more angular anodes connected to an anode bus and arranged at the top of the bath and immersed in a molten electrolyte, characterized in that the lining of the cathode assembly is made in accordance with claim 1.

* * * * *